US011517061B2

(12) United States Patent
May

(10) Patent No.: US 11,517,061 B2
(45) Date of Patent: Dec. 6, 2022

(54) ERGONOMIC DUTY BELT ASSEMBLY

(71) Applicant: Gregory May, Lévis (CA)

(72) Inventor: Gregory May, Lévis (CA)

( * ) Notice: Subject to any disclaimer, the term of this patent is extended or adjusted under 35 U.S.C. 154(b) by 0 days.

(21) Appl. No.: 15/018,110

(22) Filed: Feb. 8, 2016

(65) Prior Publication Data

US 2016/0227861 A1 Aug. 11, 2016

Related U.S. Application Data

(60) Provisional application No. 62/114,447, filed on Feb. 10, 2015.

(30) Foreign Application Priority Data

Apr. 23, 2015 (CA) ..... CA 2889214

(51) Int. Cl.
*A41F 9/02* (2006.01)
*A45F 5/02* (2006.01)

(52) U.S. Cl.
CPC ..... *A41F 9/025* (2013.01); *A45F 5/02* (2013.01); *A45F 5/021* (2013.01)

(58) Field of Classification Search
CPC .... A41F 9/00; A41F 9/025; A41F 9/02; A45F 5/02; A45F 5/021; A45F 2003/144
USPC ..... 2/321, 311, 312, 338, 322; 128/100.1, 128/101.1
See application file for complete search history.

(56) References Cited

U.S. PATENT DOCUMENTS 2,663,027 A * 12/1953 Posson ..... A41F 9/025 2/237
3,664,560 A 5/1972 Perkins
4,063,313 A 12/1977 Hagios
4,165,826 A 8/1979 Chica
4,174,793 A 11/1979 Wisowaty
(Continued)

FOREIGN PATENT DOCUMENTS

CA 2254626 5/2000
CA 2354814 7/2001
(Continued)

OTHER PUBLICATIONS

BlackHawk Industries, Inc., BlackHawk! The World's Finest Tactical Nylon, excerpt from The BlackHawk 2001, Full Line Product Catalog, 2001, 7 pages, Virginia, USA.
(Continued)

*Primary Examiner* — Jocelyn Bravo
(74) *Attorney, Agent, or Firm* — Dawn-Marie Bey; Bey & Cotropia PLLC

(57) ABSTRACT

An ergonomic duty belt assembly comprising: a longitudinally and laterally flexible inner belt having an exterior face provided with a hook and loop fabric; a longitudinally and laterally flexible supporting belt adapted to be affixed over said inner belt having an interior face provided with mating hook and loop fabric; a base material of each of said inner belt, said supporting belt, said hook and loop fabric and said mating hook and loop fabric being woven with a material having elasticity properties, thus providing longitudinal and lateral flexibility of said duty belt assembly; said outer belt being removably mountable to said inner belt, said hook and loop fabric on said inner belt being adapted to be affixed to said mating hook and loop fabric of said supporting belt.

22 Claims, 5 Drawing Sheets

(56) References Cited

U.S. PATENT DOCUMENTS 4,341,331 A 7/1982 McDougall
4,523,337 A * 6/1985 Leibowitz ..... A41B 9/14 2/237
4,569,348 A 2/1986 Hasslinger
4,676,419 A 6/1987 Victor
4,705,710 A * 11/1987 Matsuda ..... A44B 18/0034 428/92
4,838,044 A * 6/1989 Matsuda ..... A44B 18/0034 66/190
4,907,729 A 3/1990 Hess
4,957,231 A 9/1990 Kalisher
5,008,987 A 4/1991 Armour, II
5,086,758 A 2/1992 Schiek
5,086,759 A * 2/1992 Buddingh ..... A61F 5/028 128/101.1
5,135,257 A 8/1992 Short
5,152,443 A 10/1992 Hagan
5,178,163 A * 1/1993 Yewer, Jr. ..... A41F 9/002 128/876
5,233,942 A 8/1993 Cooper
5,306,045 A 4/1994 Parks
5,334,134 A * 8/1994 Saunders ..... A41D 13/0525 128/100.1
5,413,262 A 5/1995 Dewire
5,421,809 A 6/1995 Rise
5,433,359 A 7/1995 Flowers
5,464,136 A 11/1995 Eddy
5,470,000 A 11/1995 Munoz
5,497,923 A 3/1996 Pearson
5,503,620 A * 4/1996 Danzger ..... A61F 5/028 128/100.1
5,505,356 A 4/1996 Noriega
5,551,085 A 9/1996 Leighton ..... 2/44
5,570,824 A 11/1996 Lyon
5,586,969 A * 12/1996 Yewer, Jr. ..... A61F 5/028 128/101.1
5,591,122 A * 1/1997 Yewer, Jr. ..... A61F 5/028 128/100.1
5,683,022 A 11/1997 Evans
5,693,006 A 12/1997 Slautterback
5,746,542 A 5/1998 Carmichael
5,833,188 A 11/1998 Studdiford
5,881,933 A * 3/1999 Rogers ..... F41C 33/041 224/195
6,015,073 A 1/2000 Wojciak
6,056,174 A 5/2000 Minckler
6,152,338 A 11/2000 Smith
6,328,193 B1 12/2001 Schiff
6,481,528 B2 11/2002 Antonio
6,610,032 B1 8/2003 Prody
6,769,586 B1 8/2004 Beletsky
7,699,197 B2 4/2010 Panosian et al.
7,762,440 B2 * 7/2010 Cook ..... A45F 5/021 2/338
8,011,545 B2 9/2011 Murdoch
8,225,976 B2 7/2012 Meunier ..... 224/675
8,393,016 B2 * 3/2013 Wilkins-Gaudio ..... A41F 9/002 2/312
2003/0037530 A1 * 2/2003 Zhu ..... A41D 19/01505 57/246
2004/0226972 A1 * 11/2004 Cook ..... A45F 5/021 224/195
2006/0086355 A1 * 4/2006 Garth ..... A61F 5/03 128/101.1
2006/0243771 A1 11/2006 Davila
2007/0029357 A1 2/2007 Chao
2007/0033698 A1 2/2007 Long
2009/0308900 A1 * 12/2009 Kernkamp ..... A45F 3/14 224/158
2010/0100019 A1 * 4/2010 Chen ..... A61F 5/03 602/19
2010/0107310 A1 * 5/2010 Taylor ..... A41F 9/002 2/301
2010/0275344 A1 * 11/2010 Demarest ..... A41F 9/00 2/237
2013/0087141 A1 * 4/2013 Williams ..... A61F 5/028 128/100.1
2014/0041565 A1 * 2/2014 Demarest ..... A41F 9/00 112/475.06
2014/0259300 A1 * 9/2014 Iosilevich ..... A45F 5/021 2/300
2015/0143855 A1 * 5/2015 Nygard ..... A41D 1/06 66/177

FOREIGN PATENT DOCUMENTS

CA 2581800 10/2011
FR 2913864 A1 9/2008
FR 2939609 A1 6/2010
WO WO 92/19201 11/1992 ..... A61F 5/02
WO 1995001112 1/1995
WO 2000030434 6/2000
WO 2006060869 6/2006
WO 2012099874 A1 7/2012

OTHER PUBLICATIONS

BlackHawk Industries, Inc., BlackHawk! The World's Finest Tactical Gear, excerpt from The BlackHawk 2003, Full Line Product Catalog, 2003, 7 pages, Virginia, USA.

Pro Carry Systems International Inc. The Pro Carry Systems Duty Bag, webpage available at www.procarry.com/caialog/dutybelt.html at least from Feb. 13, 1997, retrieved from the Internet on the Internet Archive WayBack Machine at http://web.archive.org/web/19970213215248/http://www.procarry.com/catalog/dutybelt.html.

Pro Carry Systems International Inc. Pro Carry Duty Belt Pouches, webpage available at www.procarry.com/catalog/pouches.html at least from Feb. 13, 1997, retrieved from the Internet on the Internet Archive WayBack Machine at http://web.archive.org/web/19970213215302/http://www.procarry.com/catalog/pouches.html.

MD Charlton Co. Ltd., 2004 Catalog, Duty Gear section, pp. 73-104, available at www.mdcharlton.ca/catalogue/catalogue01.html at least from Feb. 2, 2004, retrieved from the Internet on the Internet Archive WayBack Machine at http://web.archive.org/web/20040611202527/http://www.mdcharlton.ca/downloads/2003-2004%20catalogue.pdf.

* cited by examiner

ERGONOMIC DUTY BELT ASSEMBLY

TECHNICAL FIELD

The invention relates to a duty belt assembly having an inner belt and an outer belt. More particularly, it relates to an ergonomic duty belt assembly with longitudinal and lateral stretchable capacities.

BACKGROUND OF THE ART

Duty belts assemblies are used by workers such as paramedics, firefighters, police officers, security personnel, shooting range staff, maintenance staff, custodial workers, construction workers and others, to hold accessories (such as hand tools, instruments and devices) and containers (such as pouches and holders) at waist level for extended periods of time. Examples of accessories and containers include a gun holster, a flashlight, a pepper spray container, a baton, a construction tool, a mobile phone, or a walkie-talkie pouch, etc. Because the unevenly distributed and weighted equipment is carried on the side or the front of the waist, workers often complain of back aches and pain and postural problems. The rigidity of the belt adds to the issue when workers have to maintain various upright, sitting, squatting and bent over positions.

U.S. Pat. No. 8,225,976 entitled "Belt assembly and container therefor" by Paul MEUNIER shows a belt assembly including an inner belt, a supporting belt and at least one container. The inner and supporting belts are cohesively affixed, and the supporting belt is laterally flexible and longitudinally rigid. Although this belt is somewhat flexible, it does not present a longitudinal stretch which would adjust and adapt the belt to the movements of the body at waist level, like twisting, flexion of the back, etc.

There is a need for a flexible duty belt which relieves some of the pressure on the back of the wearer during movements, flexions and twists of the body.

SUMMARY

The ergonomic duty belt offers a comfortable adaptation to the movements and positions of the body, such as flexion, twisting, seated position, tilted position, squatting position, etc.

The ergonomic duty belt assembly comprises an inner belt and an outer belt which are laterally and longitudinally flexible, thus permitting to adapt to the movements of the wearer. The flexibility is provided by a combination of threads of a stretch material woven with threads of the base material webbing constituting the duty belt. The inner and the outer belts are adapted to be firmly joined by attachment means such as layers of hook and loop fasteners (Velcro®-type fasteners). The stretch material is also woven with hook and loop fasteners fibers to offer the same stretchable properties along the duty belt.

In accordance with one broad aspect, there is provided an ergonomic duty belt assembly for holding pouches, holders, and accessories comprising: an inner belt comprising an interior face to wear around a waist, and an exterior face covered by attachment means; and a supporting belt to wear around the inner belt and comprising an interior face covered by corresponding attachment means coinciding with attachment means of the inner belt.

In accordance with another broad aspect, there is provided an ergonomic duty belt assembly for holding pouches, holders, and accessories which comprises; an inner belt having an inner face to wear around a waist, and an outer face covered by attachment means; a supporting belt to wear around said inner belt, and comprising an inner face covered by corresponding attachment means coinciding with said attachment means of said inner belt, said supporting belt comprising means for locking, tightening, and adjusting said duty belt around the waist, said supporting belt having a width at least as wide as said inner belt width, said supporting belt comprising at least one polymer insert for attachment of one or more of said pouches, holders or accessories; characterised in that both said inner and supporting belts are constituted by a main material in combination with a material having elasticity properties, said combination being done during weaving; threads of said main material and threads of said stretch material being woven together, as well as threads of said attachment means being also woven with threads of said stretch material; the elasticity properties providing a longitudinal and lateral flexibility of said duty belt.

In accordance with another broad aspect, there is provided an ergonomic duty belt assembly comprising: a longitudinally and laterally flexible inner belt having an exterior face provided with a hook and loop fabric; a longitudinally and laterally flexible supporting belt adapted to be affixed over said inner belt having an interior face provided with mating hook and loop fabric; a base material of each of said inner belt, said supporting belt, said hook and loop fabric and said mating hook and loop fabric being woven with a material having elasticity properties, thus providing longitudinal and lateral flexibility of said duty belt assembly; said outer belt being removably mountable to said inner belt, said hook and loop fabric on said inner belt being adapted to be affixed to said mating hook and loop fabric of said supporting belt.

According to still another broad aspect of the present invention, there is provided an ergonomic duty belt assembly comprising: a longitudinally and laterally flexible inner belt having an interior face adapted to be worn adjacent a wearer, and an exterior face provided with a hook and loop fabric covering at least a portion of the exterior face; a longitudinally and laterally flexible supporting belt adapted to be affixed over the inner belt, away from the wearer, comprising an exterior face and an interior face provided with mating hook and loop fabric covering at least a portion of the interior face; a base material of each of the inner belt, the supporting belt, the hook and loop fabric and the mating hook and loop fabric being woven with a material having elasticity properties, thus providing longitudinal and lateral flexibility of the duty belt assembly; the outer belt being removably mountable to the inner belt, the hook and loop fabric on the inner belt being adapted to be affixed to the mating hook and loop fabric of the supporting belt.

In one embodiment, the supporting belt further includes a locking mechanism for one of locking, tightening and adjusting the duty belt around the wearer.

In one embodiment, the supporting belt has a width at least as wide as a width of the inner belt.

In one embodiment, the supporting belt has at least one polymer insert, the polymer insert being affixed to the supporting belt and provided between the exterior face and the interior face.

In one embodiment, the base material is one of nylon, polypropylene and polyester.

In one embodiment, the material having elasticity properties is one of a polyurethane and polyester-polyurethane copolymer.

In one embodiment, the ergonomic duty belt assembly can be stretched longitudinally by a predetermined stretching factor, the predetermined stretching factor being chosen between 1% and 20% of an unstretched duty belt.

In one embodiment, the material having elasticity properties constitutes 5% to 25% of the weight of the duty belt.

BRIEF DESCRIPTION OF THE DRAWINGS

Reference will now be made to the accompanying drawings, showing by way of illustration a preferred embodiment thereof and in which:

FIG. 2 includes FIG. 2A, FIG. 2B and FIG. 2C, in which

DETAILED DESCRIPTION

Figure 1:
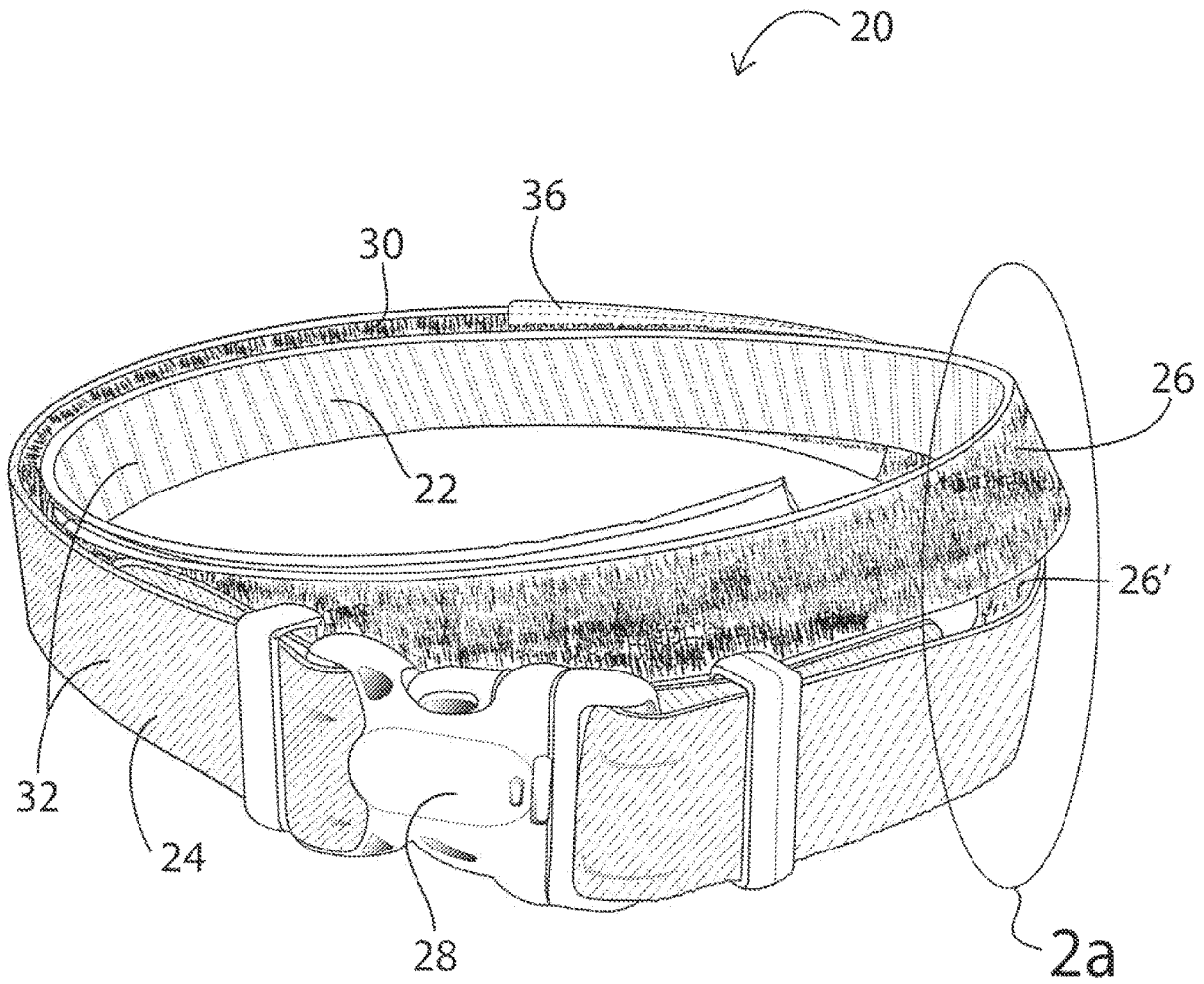
FIG. 1 is a perspective of the ergonomic duty belt assembly.

The ergonomic duty belt assembly comprises an inner belt to wear around the waist as an ordinary belt, and an outer or equipment supporting belt which is cohesively affixed to the inner belt.

The longitudinally and laterally flexible inner belt has an interior face adapted to be worn adjacent a wearer, and an exterior face provided with a hook and loop fabric covering at least a portion of the exterior face.

The longitudinally and laterally flexible supporting belt is adapted to be affixed over the inner belt, away from the wearer. It comprises an exterior face and an interior face provided with mating hook and loop fabric covering at least a portion of the interior face. The outer belt is removably mountable to the inner belt, the hook and loop fabric on the inner belt being adapted to be affixed to the mating hook and loop fabric of the supporting belt.

The base material of each of the inner belt, the supporting belt, the hook and loop fabric and the mating hook and loop fabric is woven with a material having elasticity properties, thus providing longitudinal and lateral flexibility of the duty belt assembly.

The combination of threads of the belt webbing material with threads of a stretch material renders the belt laterally and longitudinally stretchable and flexible enough to adapt to movements of the body at waist level while alleviating some of the pressure on the back and/or sides of the waist of the wearer. This dual flexibility has no substantial impact on the width or thickness of the ergonomic duty belt. Both the inner and supporting belts are constituted by a base material in combination with a material having elasticity properties. The combination of materials is carried out during the weaving operation at fabrication, threads of the base material and threads of the stretch material being woven together.

The base material constituting the webbing of the duty belt may be nylon, or polypropylene, or polyester or any combination thereof. The stretch material may be a polyurethane, or an elastomeric synthetic polyester-polyurethane copolymer such as Lycra®, Spandex® or elastane which presents elasticity capabilities and a very good resistance to extension before breaking.

Depending on the proportions of the base material and the stretch material used in the fabrication process, the ergonomic duty belt assembly can be stretched longitudinally by a predetermined stretching factor chosen between 1% and 20% of an unstretched duty belt, a flexibility of 8% being found adequate for most users. The elastomeric fibers constitute 5% to 25% of the total weight of the duty belt.

For example, for a duty belt of 81.3 cm (32 inch), the maximum longitudinal stretching could be 16.25 cm (6.4 inch) to obtain a maximum length of 97.54 cm (38.4 inch). In another example, a duty belt of 81.3 cm (32 inch) long can be stretched to 87.8 cm (34.56 inch), namely a longitudinal flexibility of about 8%, depending on the shape and size of the wearer.

In most embodiments, the supporting belt has a width at least as wide as the inner belt width. In some embodiments, the supporting belt comprises a locking mechanism for locking, tightening and/or adjusting the duty belt around the wearer.

Containers are adapted to be provided on the supporting belt for retaining and holding equipment. These containers are affixed to the supporting belt while being cohesively affixed to the inner belt. They can be placed at a location preferred to the user. The container includes a receiving compartment used for carrying the required equipment and a fixating structure. The fixating structure can be a complimentary layer of fabric of hook and loop fasteners covering at least a portion of the fixating structure and adapted to be in contact with the supporting belt when the container is affixed thereon. In other cases, the fixating structure could be a loop-type structure allowing to slide the container on the supporting belt.

The supporting belt can also comprise at least one polymer insert for receiving a container which requires a very rigid stability on the belt, such as a gun holster or a taser gun container. The polymer insert may be fabricated to be integral with the supporting belt or may be a slidable piece adapted to be removable. If the polymer insert is integral, it can be inserted and affixed between the base material layer and the fabric of hook and loop fasteners. It is therefore affixed to the supporting belt and provided between the exterior face and the interior face of the supporting belt. If it is removable, it can be slid over the supporting belt and include a layer of fabric of hook and loop fasteners for securing it to the supporting and/or inner belt.

The polymer insert has a length appropriate for its use. If it is used to hold a gun holster, a length of 7 inches has been found adequate. The width of the polymer insert is typically that of the inner or supporting belt, namely 1.5 inch (3.81 cm) or 2 inches (5.08 cm) for example. Other lengths and widths are considered.

The polymer insert is not stretchable longitudinally although it may be somewhat flexible. An example material for the polymer insert is thermoplastic polyethylene such as ultra-high-molecular-weight polyethylene (UHMWPE, UHMW).

The attachment means of the inner and the outer belts may include a layer of fabric of hook and loop fasteners, such as Velcro®-type fasteners. A layer of fabric of hook (or loop) fasteners appears on the exterior face of the inner belt while a corresponding layer of fabric of loop (or hook) fasteners appears on the interior face of the outer belt. When pressing the two layers of fabric of the hook and loop fasteners one against the other, the outer belt is cohesively joined to the inner belt. The layer of fabric of hook and loop fasteners may cover the width and longitudinal length the exterior surface of the inner belt and the interior surface of the outer belt partially or completely, so long as a substantial portion of the layers of fabric can cooperate to allow complimentary hook and loop fasteners to contact and interconnect.

The layers of hook and loop fasteners are also formed by a combination of threads of stretch material woven with threads of the base material constituting the fasteners; thus permitting stretchable properties along the duty belt.

With reference to FIG. 1, the ergonomic duty belt assembly 20 for holding containers and accessories therefore comprises an inner belt 22 to be worn at the waist of the wearer, around the waist of the wearer. It can be slid inside the belt loops of a duty garment, such as a pant. The inner belt 22 has an interior face 23 facing the waist and an exterior face 26 comprising a layer of fabric of Velcro®-type fasteners. The duty belt assembly also comprises an outer or supporting belt 24 comprising a corresponding layer 26' of fabric of Velcro®-type fasteners, on its interior face, intended to be fixedly joined to the layer of Velcro®-type fabric of the inner belt and to be worn over it.

Figure 5:
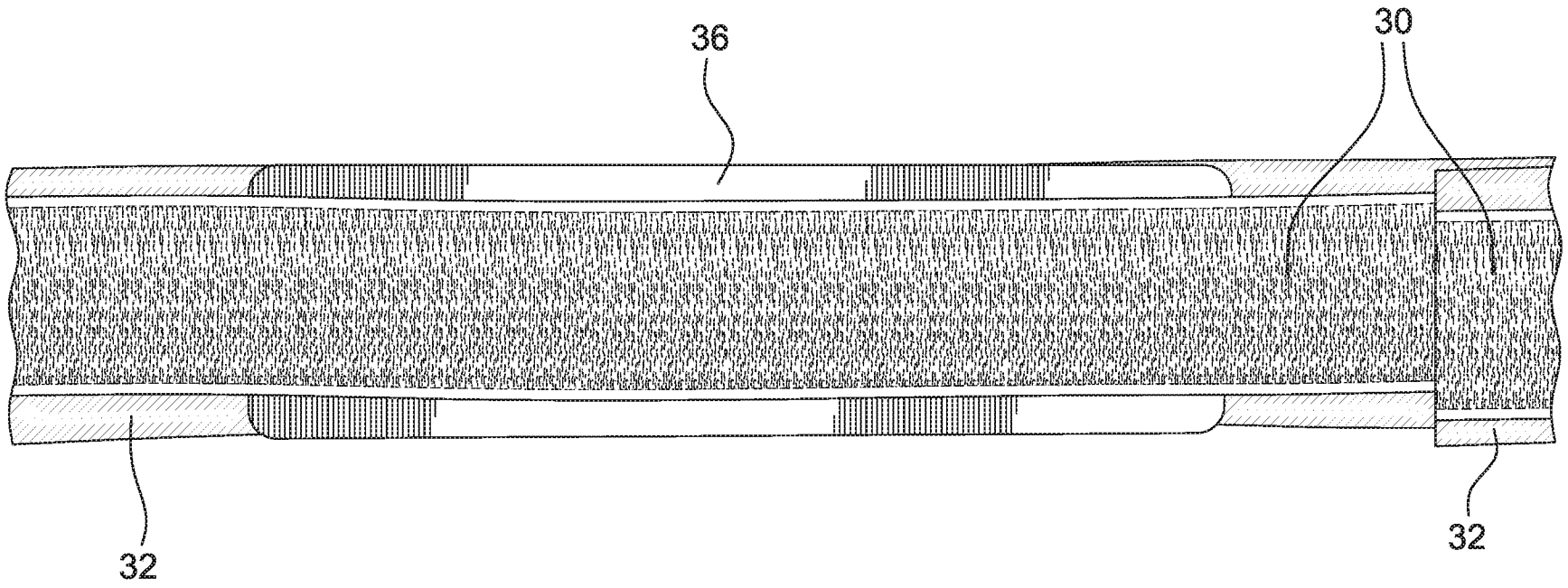
FIG. 5 shows a polymer insert on the supporting belt.

In some embodiments, the ergonomic duty belt assembly 20 also includes a polymer insert 36 affixed to the interior face of the outer belt 24. It can be formed of polymer and is typically used for positioning, holding and/or securing a pouch, holder or accessory for example a gun holster or a taser gun holder on the outer belt 24. FIG. 5 shows a polymer insert 36 affixed to a supporting belt 24 between the base material layer 32 and the hook and loop fabric layer 30.

In most embodiments, the inner belt is designed in such a manner that it fastens on itself, without requiring any locking mechanism or buckle. In some embodiments, a fastening mechanism (not shown) is provided on the inner belt 22 for sizing, securing and/or positioning it about the wearer's waist to account for various physiognomy of the wearer. Different widths of the inner belt can also be made available to help with comfort.

In some embodiments, a locking mechanism 28 (such as a buckle or other male-female arrangement) is provided on the supporting belt 24 for sizing and fastening it about the inner belt 22 and the wearer's waist. It can also serve to adjust a length of the supporting belt.

Figure 2B:
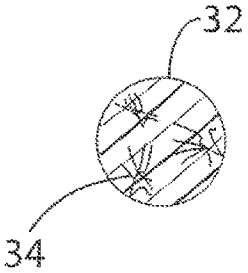
FIG. 2B is an enlarged section through layer "b" indicated in FIG. 2A
Figure 2C:
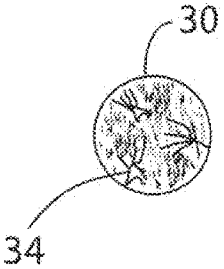
FIG. 2C is an enlarged section through layer "c" indicated in FIG. 2A.
Figure 2A:
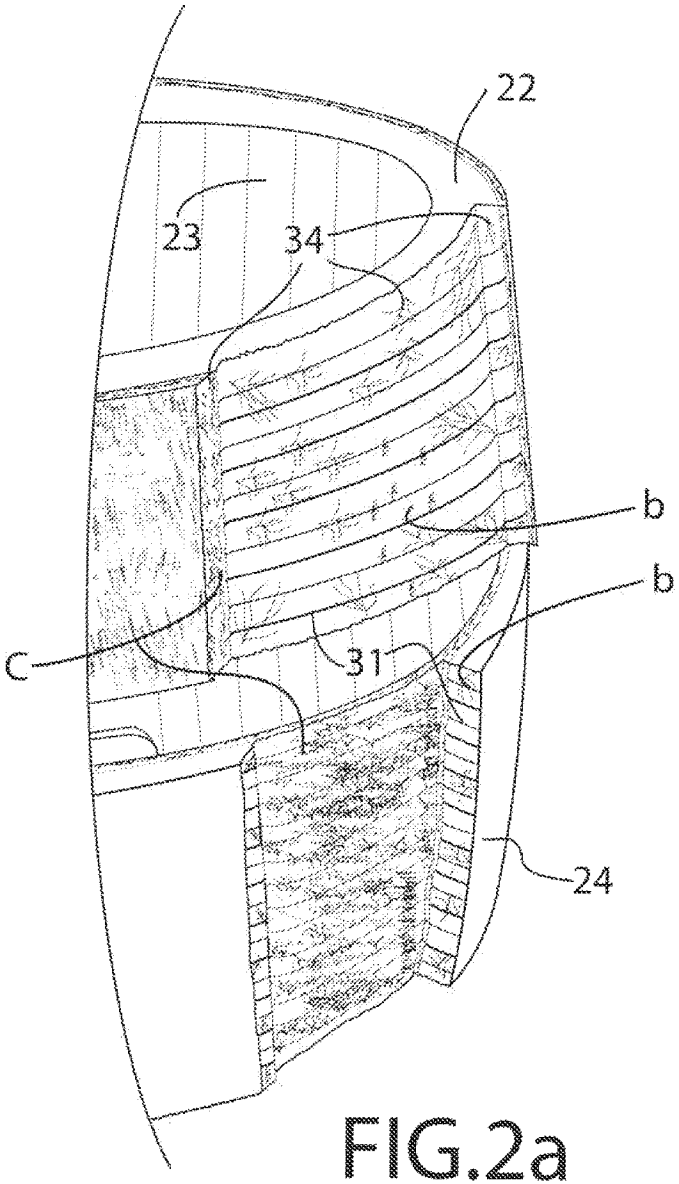
FIG. 2A is an enlarged part sectional view of the circled portion of the duty belt shown in FIG. 1, showing various layers of material.

As illustrated in FIG. 2, the material 32 of the inner belt 22 is weaved with threads of an stretch material 34. The outer belt 24 is also made with material 32 combined with threads of the same stretch material 34 as in the inner belt 22. The stretch material 34 is also woven in the layers of fabric 26 and 26' of Velcro®-type fasteners 30 to offer the same elasticity properties along the duty belt. FIG. 2B illustrates the interior face 23 of the inner belt 22 being composed of threads of base material 32 combined with stretch threads 34 and the outer layer of the outer belt 24 which is made of base material 32 combined with stretch threads 34. FIG. 2C illustrates the outer layer 26 of Velcro®-type fasteners 30 of the inner belt 22 being combined with stretch threads 34 and the inner layer of a Velcro®-type fastener 26' of the outer belt 24 being combined with stretch threads 34.

Figure 3:
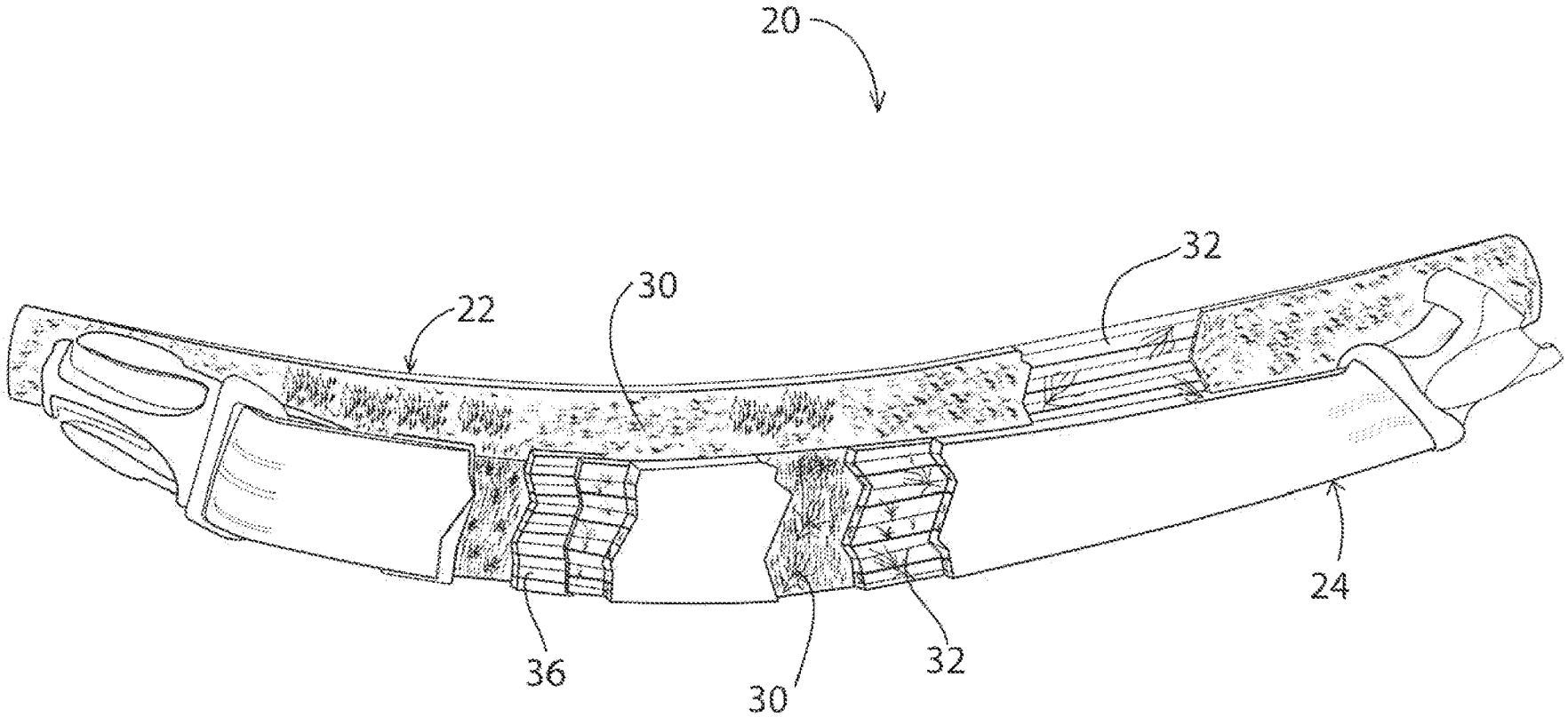
FIG. 3 is a perspective part sectional view of the duty belt showing various layers of material.

FIG. 3 shows the layers of material constituting the inner 22 and outer 24 belts in the unstretched configuration. Each belt comprises base material webbing 32 combined with stretch material 34, Velcro®-type fasteners 30, constituting attachment layers 26 and 26', having their fibers combined with stretch material 34.

In this embodiment, the outer belt 24 has a polymer insert 36 secured between the base material webbing layer and the Velcro®-type fastener.

Figure 4:
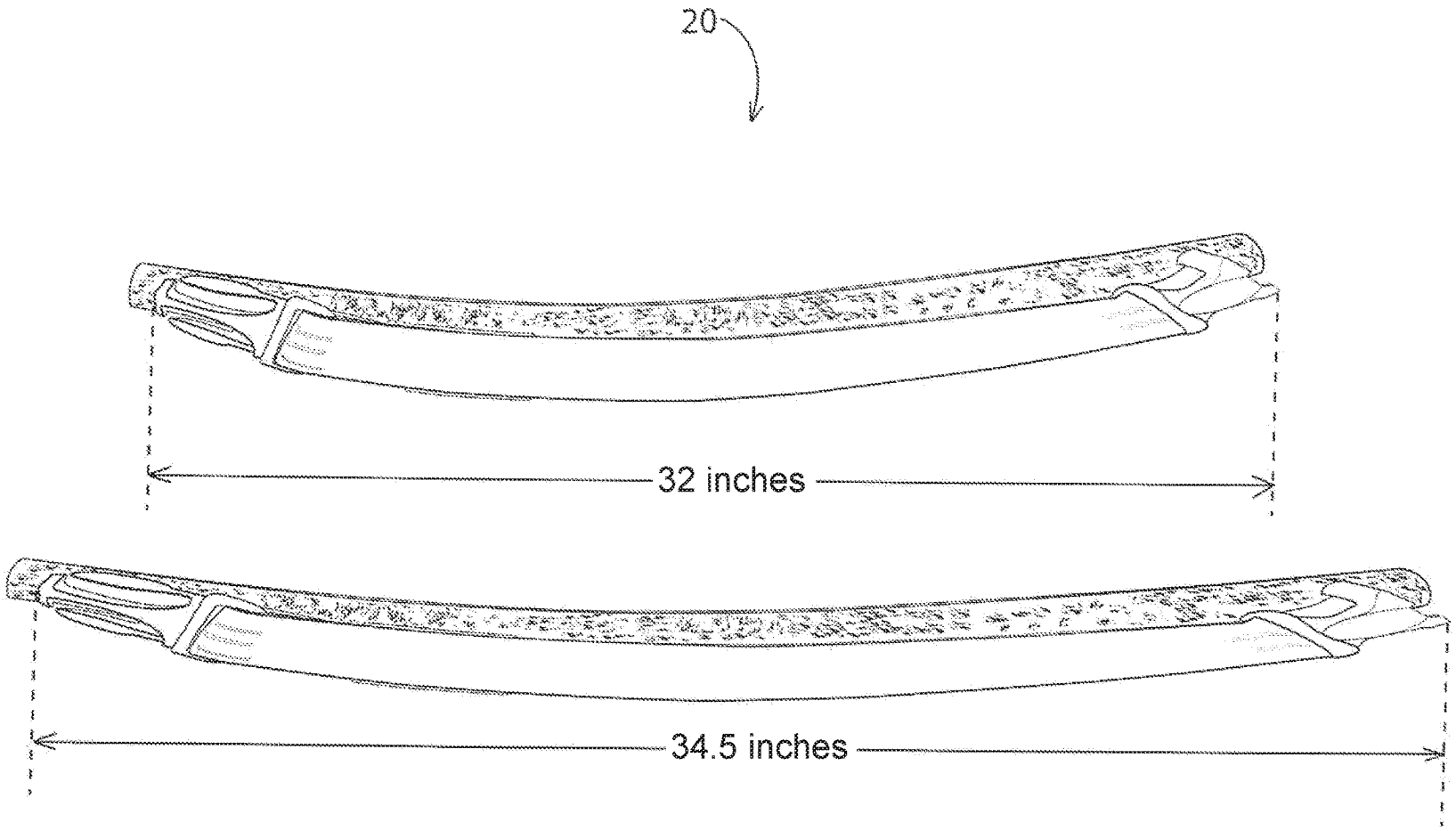
FIG. 4 shows a stretching of a duty belt.

FIG. 4 shows a duty belt assembly of 81.3 cm (32 inch) in length stretched longitudinally by 6.35 cm (2.50 inch) to achieve a length of to 87.8 cm (34.5 inch).

The duty belt assembly is manufactured in parts which are then assembled. The belt base material is first woven with the stretch material. In parallel, the attachment layers having Velcro®-type fasteners are also woven with the stretch material. An attachment layer is then affixed to a belt base layer to create an inner or an outer belt.

The combined material is then dyed and heated/cured to give it the required flexibility and stretch. Heat temperature may be comprised between 190° F. (87.77° C.) and 250° F. (121.11° C.) for a duration of the heating sequence of about 30 to 120 min.

In an example dyeing sequence, a length of 1800 yards of belt material is dyed at 30 yards per minute yielding an overall duration in the dying machine of approximately 60 minutes with the steamer temperature being approximately 220° F. (104.04° C.).

The width and quantity of material (its volume) placed in the dyeing bin as well as the outside temperature and humidity will affect the heating sequence length.

Any additional components such as a polymer insert, a container, a locking mechanism or other are affixed to the belts before or after the dyeing step, depending on the required material characteristics.

As will be readily understood, although the wearer is usually expected to be human worker, duty belts could be manufactured to fit animals, such as duty dogs or mules, for example, without departing from the invention.

EXAMPLES

The following tables show example production data for manufacturing an ergonomic duty belt assembly. Two examples are presented, a 1.5 inch (3.81 cm) wide and 32 inch (81.3 cm) long belt and a 2 inch (5.08 cm) wide and 32 inch (81.3 cm) long belt.

As will be readily understood by one skilled in the art, other width, thickness, weight and length combinations could be used. Other materials could be used. Furthermore, tolerances will be determined based on the application.

TABLE 1

Dimensional information for a 1.5 inch (3.81 cm) wide and 32 inch (81.3 cm) long belt.

| Dimensional Info | Target |
|---|---|
| Width | 1½" (3.81 cm) |
| Thickness | 0.115" (0.29 cm) |
| Weight | 179.94 lbs/1000 yds (89.26 kg/1000 m) |
| Stretch material proportion | 16.6% of total weight |

TABLE 2

Weaving information for a 1.5 inch (3.81 cm) wide and 32 inch (81.3 cm) long belt.

| | Denier | Ends | Material |
|---|---|---|---|
| Ground Direct | 1680 | 197 | Nylon |
| Ground - Ball | 1680 | 23 | Nylon |
| Creel | 1680 | 96 | Spandex Rubber |
| Lockstich | 420/1 | 1 | Nylon T6 |
| Filling | 840 | 1 | Nylon T6 |

TABLE 3

Dimensional information for a 2 inch (5.08 cm) wide 32 inch (81.3 cm) long belt.

| Dimensional Info | Target |
|---|---|
| Width | 2" (5.08 cm) |
| Thickness | 0.115" (0.29 cm) |
| Weight | 242.67 lbs/1000 yds (120.37 kg/1000 m) |
| Stretch material proportion | 13.9% of total weight |

TABLE 4

Weaving information for a 2 inch (5.08 cm) wide 32 inch (81.3 cm) long belt.

| | Denier | Ends | Material |
|---|---|---|---|
| Ground Direct | 1680 | 269 | Nylon |
| Ground - Ball | 1680 | 32 | Nylon |
| Creel | 1680 | 132 | Spandex Rubber |
| Lockstich | 420/1 | 1 | Nylon T6 |
| Filling | 840 | 1 | Nylon T6 |

The embodiments described above are intended to be exemplary only. The scope of the invention is therefore intended to be limited solely by the appended claims.

I claim:

1. A non-rigid, flexible ergonomic duty belt assembly comprising:

a longitudinally and laterally flexible inner belt having an interior face adapted to be worn adjacent to a wearer, and an exterior face provided with a hook and loop fabric covering at least a portion of said exterior face;

a longitudinally and laterally flexible outer belt configured to support equipment sized to encircle a full circumference of a waist of the wearer and adapted to be affixed over said inner belt, away from said wearer, comprising an exterior face and an interior face provided with a mating hook and loop fabric covering at least a portion of said interior face;

wherein the inner belt includes (i) a first length of a first base material woven with a first material having elastic properties, wherein the longitudinal and lateral flexibility of the inner belt results from heating the first length of the first base material woven with the first material having elastic properties at a temperature in a range of 190 to 250 degrees Fahrenheit for a duration in a range of 30 to 120 minutes, and (ii) the hook and loop fabric, wherein the hook and loop fabric comprises a first length of a hook or loop fastener material woven with a second material having elastic properties; and wherein the equipment supporting outer belt includes (iii) a second base material woven with a third material having elastic properties, wherein the longitudinal and lateral flexibility of the equipment supporting outer belt results from heating the third length of the second base material woven with the third material having elastic properties at a temperature in a range of 190 to 250 degrees Fahrenheit for a duration in a range of 30 to 120 minutes, and (iv) the mating hook and loop fabric, wherein the mating hook and loop fabric comprises a second length of a hook or loop fastener material mateable with the first length of the hook or loop fastener material, woven with a fourth material having elastic properties, thus providing longitudinal and lateral flexibility of said duty belt assembly; and the equipment supporting outer belt being removably mountable to said inner belt, said hook and loop fabric on said inner belt being adapted to be affixed to said mating hook and loop fabric of said equipment supporting outer belt.

2. The ergonomic duty belt assembly of claim 1, wherein said equipment supporting outer belt further includes a locking mechanism for one of locking, tightening and adjusting said duty belt assembly around said wearer.

3. The ergonomic duty belt assembly of claim 1, wherein said equipment supporting outer belt has a width at least as wide as a width of said inner belt.

4. The ergonomic duty belt assembly of claim 1, wherein said equipment supporting outer belt has at least one polymer insert for supporting the equipment, said polymer insert being affixed to said equipment supporting outer belt and provided between said exterior face of the equipment supporting outer belt and said interior face of the equipment supporting outer belt.

5. The ergonomic duty belt assembly of claim 1, wherein the first base material is one of nylon, polypropylene and polyester, and the second base material is one of nylon, polypropylene and polyester.

6. The ergonomic duty belt assembly of claim 5, wherein each of the first and second base materials is a same one of nylon, polypropylene and polyester.

7. The ergonomic duty belt assembly of claim 6, wherein each of the first, second, third and fourth materials having elastic properties is a same one of a polyurethane or a polyester-polyurethane copolymer.

8. The ergonomic duty belt assembly of claim 1, wherein the first material having elastic properties is one of a polyurethane and polyester-polyurethane copolymer, the second material having elastic properties is one of a polyurethane and polyester-polyurethane copolymer, the third material having elastic properties is one of a polyurethane and polyester-polyurethane copolymer, and the fourth material having elastic properties is one of a polyurethane and a polyester-polyurethane copolymer.

9. The ergonomic duty belt assembly of claim 8, wherein each of the first, second, third and fourth materials having elastic properties is a same one of a polyurethane or a polyester-polyurethane copolymer.

10. The ergonomic duty belt assembly of claim 1 wherein said ergonomic duty belt assembly can be stretched longitudinally by a predetermined stretching factor, said predetermined stretching factor being chosen between 1% and 20% of an unstretched duty belt assembly.

11. The ergonomic duty belt assembly of claim 1, wherein a total weight of the first, second, third and fourth materials having elastic properties together constitutes 5% to 25% of the weight of said duty belt assembly.

12. A non-rigid, flexible ergonomic duty belt assembly comprising:

a longitudinally and laterally flexible inner belt having an interior face adapted to be worn adjacent to a wearer, and an exterior face provided with a hook and loop fabric covering at least a portion of said exterior face;

a longitudinally and laterally flexible outer belt configured to support equipment sized to encircle the full circumference of a waist of the wearer and adapted to be affixed over said inner belt, away from said wearer, comprising an exterior face and an interior face provided with a mating hook and loop fabric covering at least a portion of said interior face;

wherein the inner belt includes (i) a first length of a first base material woven with a first material having elastic properties, and (ii) the hook and loop fabric, wherein the hook and loop fabric comprises a first length of a hook or loop fastener material woven with a second material having elastic properties; and wherein the equipment supporting outer belt includes (iii) a second base material woven with a third material having elastic properties, and (iv) the mating hook and loop fabric, wherein the mating hook and loop fabric comprises a second length of a hook or loop fastener material mateable with the first length of the hook or loop fastener material, woven with a fourth material having elastic properties, thus providing longitudinal and lateral flexibility of said duty belt assembly; and the equipment supporting outer belt being removably mountable to said inner belt, said hook and loop fabric on said inner belt being adapted to be affixed to said mating hook and loop fabric of said equipment supporting outer belt.

13. The ergonomic duty belt assembly of claim 12, wherein said equipment supporting belt further includes a locking mechanism for one of locking, tightening and adjusting said duty belt assembly around said wearer.

14. The ergonomic duty belt assembly of claim 12, wherein said equipment supporting belt has a width at least as wide as a width of said inner belt.

15. The ergonomic duty belt assembly of claim 12, wherein said equipment supporting belt has at least one polymer insert for supporting the equipment, said polymer insert being affixed to said equipment supporting belt and provided between said exterior face of the equipment supporting belt and said interior face of the equipment supporting outer belt.

16. The ergonomic duty belt assembly of claim 12, wherein the first base material is one of nylon, polypropylene and polyester, and the second base material is one of nylon, polypropylene and polyester.

17. The ergonomic duty belt assembly of claim 16, wherein each of the first and second base materials is a same one of nylon, polypropylene and polyester.

18. The ergonomic duty belt assembly of claim 17, wherein each of the first, second, third and fourth materials having elastic properties is a same one of a polyurethane or a polyester-polyurethane copolymer.

19. The ergonomic duty belt assembly of claim 12, wherein the first material having elastic properties is one of a polyurethane and polyester-polyurethane copolymer, the second material having elastic properties is one of a polyurethane and polyester-polyurethane copolymer, the third material having elastic properties is one of a polyurethane and polyester-polyurethane copolymer, and the fourth material having elastic properties is one of a polyurethane and a polyester-polyurethane copolymer.

20. The ergonomic duty belt assembly of claim 19, wherein each of the first, second, third and fourth materials having elastic properties is a same one of a polyurethane or a polyester-polyurethane copolymer.

21. The ergonomic duty belt assembly of claim 12 wherein said ergonomic duty belt assembly can be stretched longitudinally by a predetermined stretching factor, said predetermined stretching factor being chosen between 1% and 20% of an unstretched duty belt assembly.

22. The ergonomic duty belt assembly of claim 12, wherein a total weight of the first, second, third and fourth materials having elastic properties together constitutes 5% to 25% of the weight of said duty belt assembly.

* * * * *